United States Patent [19]

Reschke

[11] 4,072,382

[45] Feb. 7, 1978

[54] SAFETY OUTLET

[76] Inventor: Kurt W. Reschke, 21515 Thorofare, Grosse Ile, Mich. 48138

[21] Appl. No.: 691,979

[22] Filed: June 2, 1976

[51] Int. Cl.[2] ..... H01R 13/44

[52] U.S. Cl. ..... 339/40; 339/41

[58] Field of Search ..... 339/39, 40, 41, 43

[56] References Cited

U.S. PATENT DOCUMENTS

| | | | |
|---|---|---|---|
| 2,752,581 | 6/1956 | Benander | 339/41 |
| 3,222,631 | 12/1965 | Cohen | 339/40 |
| 3,713,074 | 1/1973 | Pasbrig | 339/41 |
| 3,986,763 | 10/1976 | Sparrow | 339/40 |

*Primary Examiner*—Roy Lake
*Assistant Examiner*—Neil Abrams
*Attorney, Agent, or Firm*—Harness, Dickey & Pierce

[57] ABSTRACT

There is disclosed herein a safety outlet having means which prevent the insertion of objects other than an electrical plug which may engage an electrical contact within the outlet thereby eliminating the hazard of accidental shock. The safety outlet comprises a sliding member housed within a cap member which prevents access to the electrical contacts unless actuated by means of the prongs of an electrical plug. Latching means may also be provided to further insure against actuation by objects other than the prongs of an electrical plug. Additionally, means for preventing the withdrawal of the plug without first returning the outlet to a safe position may be incorporated herein. The safety outlet of the present invention is adapted for any form of electrical connection, including conventional wall outlets and extension cord connectors.

14 Claims, 14 Drawing Figures

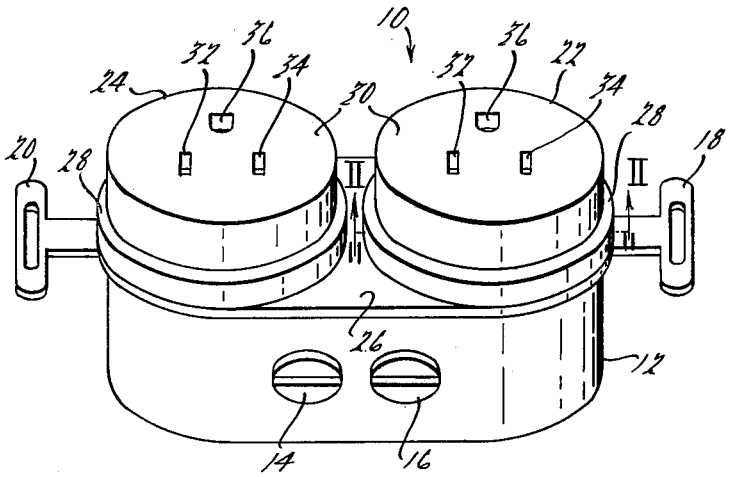
FIG. 1.
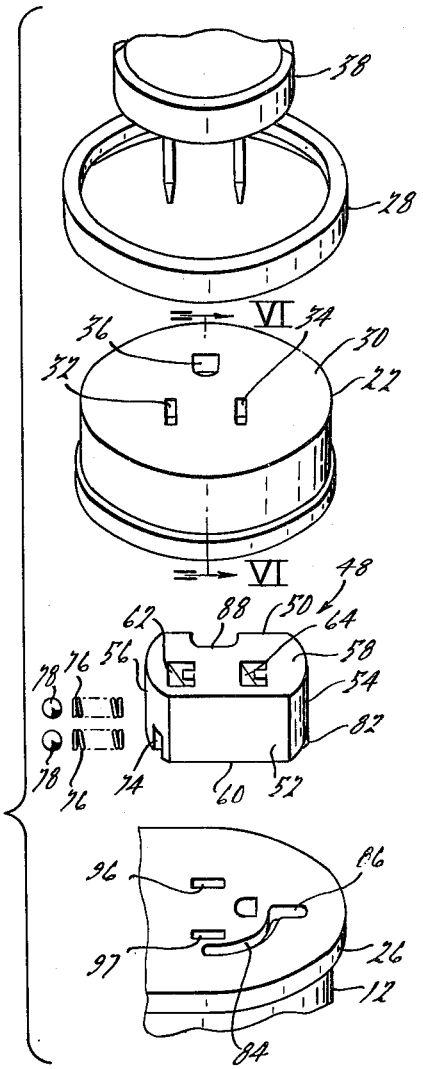
FIG. 4.
FIG. 2.
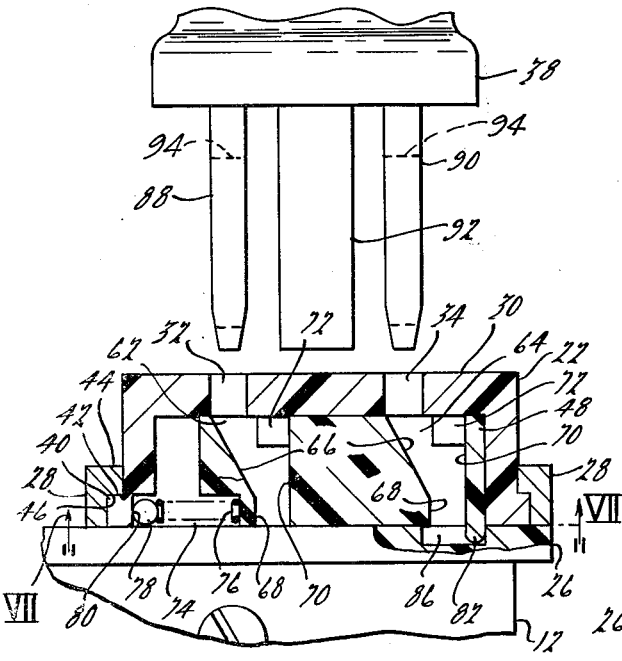
FIG. 3.
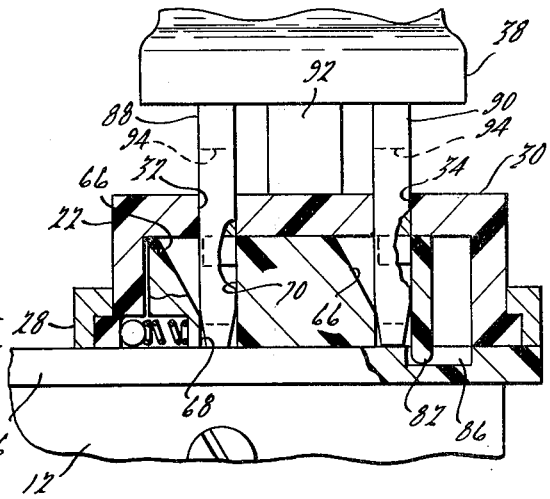

SAFETY OUTLET

BACKGROUND AND SUMMARY OF THE INVENTION

The present invention relates to electrical connectors of the type suitable for use with conventional two or three prong electrical plugs and, in particular, to such electrical connectors having incorporated therein means to prevent the accidental insertion of foreign objects which may touch an electrical contact contained therein causing an individual to receive an electrical shock.

Conventional electrical outlets generally have electrical conductors recessed in slotted apertures in order to allow a plug to be easily and removably connected thereto. However, in such devices the female conductors generally remain "hot" after removal of the plug and the slotted apertures within which they are housed afford curious youngsters an inviting receptacle in which to insert various objects they may come to find. Should any of these objects be of an electrically conductive material, there exists a high probability that the child will receive a painful electrical shock, which may cause burns or even prove fatal should the child be sufficiently well grounded. As every house, as well as most other buildings, have numerous such outlets installed in convenient floor level locations easily accessible to children, the magnitude of this potential hazard thereby created may be easily appreciated. Also, similar connectors are commonly supplied with various types of extension cords which afford additional sources of potential injury to children or other careless individuals.

One device commercially available which attempts to remove this potential hazard is an insulating type insert generally formed of a plastic composition and having prongs spaced so as to fit snugly into the slotted apertures and thereby seal the contacts from such foreign objects being accidently inserted. However, such devices can only be used on those receptacles not having an electrical appliance or the like operating thereform and, thus, it becomes relatively simple for a child to remove the plug and thereby gain access to the electrical contacts. Also, as the child will likely observe a parent or other such person remove and replace such devices, they become an added attraction for the curious minds of these children who, in attempting to mimic their parents, will readily learn how to remove the devices themselves. Further, such devices are inconvenient to use as they may be misplaced or lost when temporarily removed, or the individual may forget to replace them after unplugging the appliance.

Other attempts to provide such a safety outlet have employed rotatable caps either incorporated into the outlet itself or designed as part of a cover plate for use on conventional duplex outlets. Generally, such devices employ a rotatable cap having slotted apertures therein aligned to receive a conventional plug. The plug is first partially inserted into the rotatable cap, then turned normally on the order of 90° so as to align the plug with a lower set of slotted apertures which allow the plug to be fully inserted. However, these safety outlets generally provide no biasing means to return the rotatable cap to its safe position when a plug is withdrawn and, therefore, require that the individual manually rotate the plug 90° when withdrawing it in order to regain the safety baffle arrangement. Such devices are, therefore, inconvenient to use, and in addition, may inadvertently be left in the aligned position, thus defeating any protection which may otherwise be afforded. Further, even when some sort of biasing is provided, there is generally no provision to prevent rotation without first inserting a plug and the snapping sound of the return will serve further to attract children. The ingenious child will soon figure out that the outer cap may be easily rotated to gain access to the deeper receptacle as well as the live electrical contacts.

The present invention overcomes these disadvantages in providing a safety outlet having means which insure the outlet is returned to a safe position upon removal of the plug without the necessity of removing and reinstalling parts. In one embodiment of the present invention, a safety outlet is provided having means for locking a rotatable cap automatically when a plug is removed therefrom and further providing a unique sliding baffle arrangement which prevents the insertion of any foreign objects. Additionally, means are provided by which the plug may not be withdrawn without returning the rotatable cap to the closed position, thus insuring that the safety features of the receptacle will not be defeated by inadvertently forgetting to return the device to the protected position while eliminating the need for additional moving parts which necessarily increase production and product costs and are subject to breakage with age.

In another embodiment of the present invention, a sliding member is provided which affords a baffle arrangement preventing access to the electrical contacts unless actuated by the insertion of a plug. Additionally, latching means may be incorporated on the sliding member, thereby further insuring against actuation of the device by objects other than the prongs of a plug. In both cases, the sliding member is adapted to automatically return to the safe position upon withdrawal of the plug, thereby insuring that the outlet will not inadvertently be left in an unsafe position.

Further, the present invention also is adapted to be easily installed in place of existing duplex outlets or to replace conventional connectors on existing extension cords.

Additionally, the present invention effectively minimizes moving parts which may wear or break, thereby affording a durable product which may easily be manufactured at a cost comparable to conventional unprotected duplex outlets or extension cord connectors.

Additional advantages and features of the present invention will become apparent from the detailed description of the preferred embodiment taken in conjunction with the drawings.

BRIEF DESCRIPTION OF THE DRAWINGS

FIG. 1 is a perspective view of a safety outlet of the present invention embodied in a duplex outlet;

FIG. 2 is a view of a portion of the safety outlet of FIG. 1 shown in section along line II—II of FIG. 1;

FIG. 3 is a view similar to that of FIG. 2 but having a plug partially inserted thereon;

FIG. 4 is an exploded perspective view of the components of the safety outlet;

DETAILED DESCRIPTION OF THE PREFERRED EMBODIMENT

Figure 5:
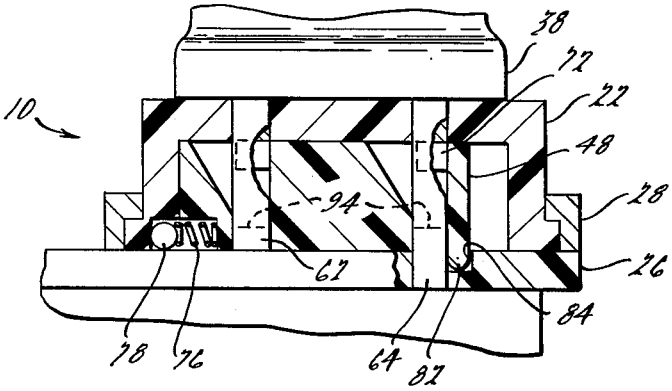
FIG. 5 is a view of the safety outlet of the present invention similar to FIGS. 2 and 3 but having a plug fully inserted in operative position therein.

Referring now to the drawings and, in particular, FIG. 1, there is shown a safety outlet generally indicated at 10. Outlet 10 has a base portion 12 in which is disposed the electrical contacts (not shown) which are designed to engage the prongs of a conventional plug. The internal configuration of the electrical contacts is similar to that of conventional duplex outlets, both the operation and construction of which are well known in the art and, hence, detailed description thereof is believed unnecessary. Base portion 12 also has a pair of screws 14 and 16 disposed on the side thereof for connection of incoming and outgoing electrical conductors. A like pair of screws is similarly disposed on the opposite side of base 12. Extending outward from either longitudinal end of base portion 12 are mounting tabs 18 and 20, which are also similar to such mounting provisions provided on conventional duplex outlets. Base 12 and mounting tabs 18 and 20 are designed so as to allow outlet 10 to be installed in an existing conventional electrical box without requiring any modification thereof. Outlet 10 also has a pair of rotatable caps 22 and 24 disposed on its upper surface, each of which is movably secured to a retainer plate 26 through the agency of a retaining ring 28. Retainer plate 26 is fastened to base portion 12. Rotatable caps 22 and 24 are identical in construction, being generally cylindrical in shape with a flat top surface 30 in which is disposed a pair of substantially parallel spaced apart slotted apertures 32 and 34 adapted to accommodate a conventional electrical plug. A third aperture 36, shaped generally as shown, may also be provided to accommodate a grounding pin of a plug if so desired.

A partially sectioned view along line II—II of outlet 10 is shown in FIG. 2 in an "off" or "safe" position with a plug 38 about to be inserted therein. Only one half of outlet 10 of FIG. 1 is illustrated in FIGS. 2, 3, 4 and 5 in order to avoid unnecessary repetition, in that identical construction is employed for each side thereof. Also, in order to facilitate understanding of the various parts and their interrelationship, the same numerals are used to indicate identical portions throughout the various figures.

As previously mentioned, rotatable cap 22 is generally cylindrical in shape and also has an annular outwardly extending flange portion 40 disposed at its lower edge, as seen in FIG. 2 so as to form a circumferential shoulder portion 42. Retaining ring 28 is generally round in shape having a straight wall portion extending upward from retainer plate 26, as viewed in FIG. 2, and has an inwardly extending circumferential flange portion 44, which forms a shoulder 46. Shoulder portion 46 of retaining ring 28 engages shoulder portion 42 of rotatable cap 22 so as to retain it in position on retainer plate 26 while still allowing it to be rotated within the retaining ring. Retaining ring 28 is fixedly secured to retainer plate 26. Rotatable cap 22 projects a substantial distance above retainer ring 28 so as to form an interior cavity in which is disposed a slidably mounted member 48. Member 48 is retained within rotatable cap 22 in such a manner as to restrict the movement thereof relative to cap 22 within a single plane, as will be described in greater detail below.

Member 48 is shaped generally as shown in FIG. 4 having substantially parallel sides 50 and 52 and curved end portions 54 and 56, top portion 58, and bottom portion 60. The radius of curvature of end portions 54 and 56 is substantially equal to the internal radius of rotatable cap 22. Member 48 also has a pair of generally "U" shaped apertures 62 and 64 disposed in top portion 58 and each extending through member 48 along an irregular path. Apertures 62 and 64 take on a generally rectangular cross section interiorly of member 48. Aperture 62 is defined by an inclined or diagonally extending side wall portion 66 which joins with a wall portion 68 extending perpendicularly upward, as shown, from bottom portion 60, sidewall 70 extending perpendicularly between top and bottom portions 58 and 60, and a tab portion 72 extending from side wall 70 toward side wall portion 66. Tab portion 72 gives aperture 62 its "U" shaped appearance when viewed from surface 58. Tab portion 72 is adapted to pass through a slot contained in the prong of a plug, as best seen in FIG. 3, so as to prevent it from being withdrawn unless rotatable cap 30 is returned to its "off" or "safe" position. A pair of parallel side wall portions extend between side wall portion 70 and opposing side wall portions 66 and 68, thus completing the definition of aperture 62. Aperture 64 has an interior construction identical to that of aperture 62 and, therefore, the same numerals have been used to designate corresponding interior wall portions.

Member 48 also has a grooved portion 74 located adjacent side 52 and opening into side 56 as well as bottom 60. Grooved portion 74 is adapted to retain a spring 76 which extends outward therefrom, engaging a small sphere 78 which bears against an interior wall portion 80 of rotatable cap 22 so as to bias member 48 to a position in which surface 54 engages the interior wall portion of rotatable cap 22 (to the right, as seen in FIG. 2).

Member 48 further has a protrusion 82 extending outward from bottom portion 60 which projects into and is designed to travel in a slot 84 formed in base portion 26. As best seen with reference to FIG. 4, slot 84 has an extension portion 86 shaped generally as shown, which prevents member 48 and rotatable cap 22 from being turned when member 48 is in its "off" position, as shown in FIG. 2.

Also, it should be noted that if outlet 10 is provided with a third aperture for receiving a grounding pin as sometimes provided on a conventional plug, member 48 must additionally have a generally arcuate indentation 88 on wall portion 50, which prevents the grounding pin from restricting the lateral movement of member 48 as it passes through rotatable cap 22.

Rotatable cap 22 and retaining ring 28 must be fabricated from a material having a high dielectric strength such as, for example, a plastic composition similar to that presently used in the manufacture of conventional outlet face members. Member 48 may also be fabricated from a similar material; however, should it be desirable, this member may be fabricated from any suitable metal, as it will be fully insulated by rotatable cap 22 and thus, does not create a shock hazard.

The operation of outlet 10 is best seen in FIGS. 2 and 3. In FIG. 2, electrical contact prongs 88 and 90 and grounding pin 92 of plug 38 are about to be inserted in safety outlet 10, which is illustrated in its "off" and "safe" position. In this position, member 48 is biased by springs 76 to the extreme right position in which apertures 62 and 64 of member 48 will be aligned with apertures 32 and 34 disposed in rotatable cap 22. Also, protrusion 82 will be disposed in locking portion 86 of slot 84 thereby preventing rotatable cap 22 from being turned.

As electrical contact prongs 88 and 90 of plug 38 are inserted into and through respective apertures 32 and 34 of rotatable cap 22, they will engage wall portion 66 of member 48. As side wall portion 66 is inclined, further insertion of prongs 88 and 90 will exert a lateral force on member 48 sufficient to overcome the opposed biasing force exerted by springs 76, thereby causing member 48 to move laterally to the left, as seen in FIGS. 2 and 3. As member 48 moves laterally to the left, tabs 72 will enter elongated slotted apertures 94 contained in prongs 88 and 90 of plug 38. Further, as member 48 moves laterally, protrusion 82 will move out of engagement with locking portion 86 and into the main portion of slot 84, thereby allowing rotatable cap 22, member 48 and plug 38 to be turned in a clockwise direction as shown.

Plug 38 is first inserted as far as possible, as shown in FIG. 3. The combination of plug 38, member 48 and rotatable cap 22 are then rotated approximately 90° to bring the prongs 88 and 90 of plug 38 into alignment with apertures 96 and 97 of base 26, thereby allowing the plug to be fully inserted and electrical contact prongs 88 and 90 to complete the electrical connection in a conventional manner. Once member 48 has been rotated a few degrees, slot 84 in cooperation with protrusion 82, will prevent member 48 from any lateral movement and, therefore, any attempt to remove plug 38 therefrom will be prevented by the engagement of tabs 72 with elongated slots 94 in prongs 88 and 90 unless rotatable cap is first returned to its lock position.

A plug 38, fully inserted and in operative relationship to safety outlet 10, is shown in FIG. 5. As is readily apparent therein, member 48 has been caused to move to the extreme left by the insertion of plug 38, and tabs 72 now engage the slots 94 contained in the prongs of plug 38. Protrusion 82 on member 48 is contained within slot 84, which prevents member 48 from moving to the right, as shown, thereby preventing tabs 72 from moving out of engagements with the slots 94 in the plug prongs and thereby preventing plug 38 from being fully withdrawn when rotated cap 22 is in the "on" or "operating" position.

Figure 6:
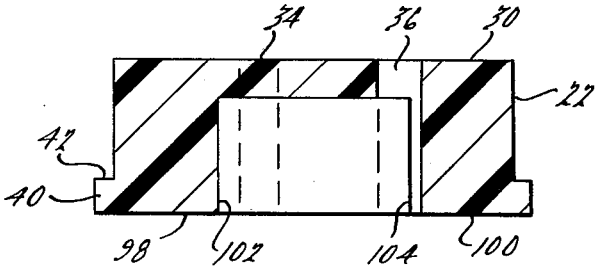
FIG. 6 is a view of the rotatable cap sectioned along line VI—VI of FIG. 4.

Rotatable cap 22 is shown in FIG. 6 sectioned along line VI—VI of FIG. 4. As shown therein, cap 22 has two flange portions 98 and 100 extending inward from the sidewall portions thereof. The inner edges 102 and 104 of flanges 98 and 100 form chords across the inner diameter of rotatable cap 22 and engage side wall portions 50 and 52 of member 48 so as to restrict the movement of member 48 therebetween.

Figure 7:
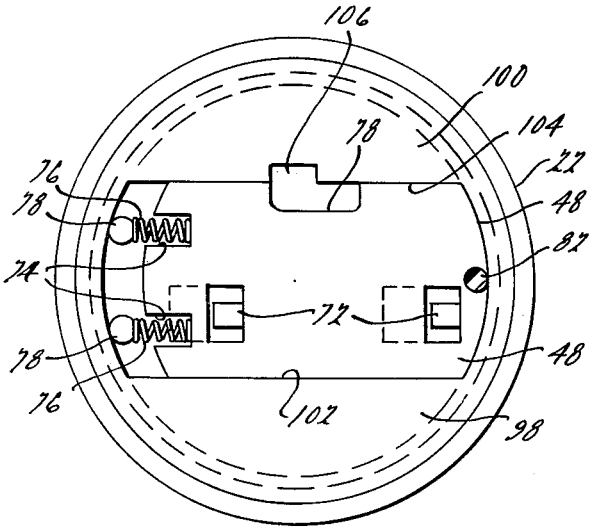
FIG. 7 is a bottom view of the safety outlet taken along line VII—VII of FIG. 2.

The relationship of flanges 98 and 100 to member 48 may be best seen by reference to FIG. 7, which is a view of rotatable cap 22 with member 48 disposed therein, taken along line VII—VII of FIG. 2. Edge 104 of flange portion 100 has a generally rectangular shaped indentation 106 therein which, in cooperation with indentation 88 of member 48, allows a plug having a grounding pin thereon to be inserted in the safety outlet. As shown, indentation 88 is substantially wider than indentation 106 so as to allow member 48 to move laterally without interference from the grounding pin of the plug.

When the safety outlet of the present invention is installed in a wall outlet, it will be necessary to provide a cover to prevent access to the interior of the electrical box. As the rotatable cap is slightly larger and generally round in shape, the existing cover having generally oval apertures therein, must be modified to accommodate this safety outlet. This may be easily accomplished by sawing or filing of the existing cover to enlarge these apertures sufficiently to accommodate rotatable cap 22. Alternatively, it may be desirable to provide a replacement cover constructed of like material and in the same manner as conventional cover plates but having the apertures therein sized to cooperate with the safety outlet of the present invention.

Figure 8:
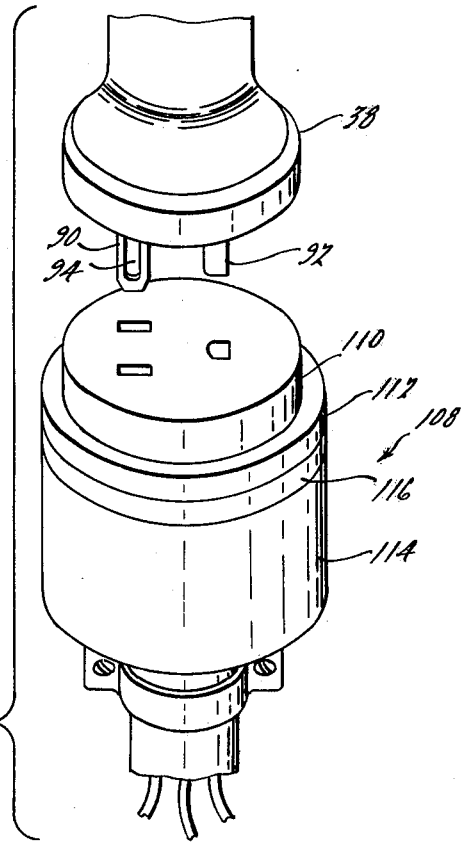
FIG. 8 is a view of a safety outlet of the present invention embodied in an extension cord electrical connector.

In FIG. 8, there is shown another embodiment of the present invention adapted for use on an extension cord electrical connector, indicated generally at 108. Safety outlet 108 has a rotatable cap 110, retaining ring 112 and a slidable member including springs (not shown), all of which are identical in construction and operation to those described with reference to duplex outlet 10 and thus further description thereof is omitted as being merely repetitious. In this embodiment, retaining ring 112 is secured to the end portion of a housing 114 containing electrical contacts therein. Both housing 114 and the electrical contacts therein are similar to those furnished with conventional extension cords with the only modification being the addition of a groove and locking portion on the top surface of retainer plate 116 identical to that formed on face plate 26 of FIG. 4 and indicated at 84 and 86 respectively.

Figure 9:
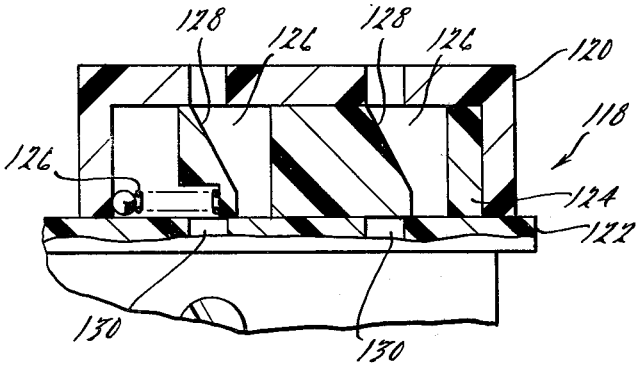
FIG. 9 is a sectionalized view of another embodiment of the present invention similar to that of FIG. 5.

Referring now to FIG. 9, there is illustrated therein yet another embodiment of the present invention indicated generally at 118. This is a sectionalized view of a single outlet similar to that of FIG. 2 although sectioned along a plane lying at a right angle to the section plane of FIG. 2. Safety outlet 118 has a cap member 120 similar to rotatable cap 22 but, in this case, the cap member is not adapted to be rotated but rather is fixedly secured to the retainer plate 122. Cap member 120 is substantially identical in construction to that of rotatable cap 22, as shown in FIG. 6, except that shoulder portion 41 and flange portion 40 have been eliminated as cap member 120 is fixedly secured to retainer plate 122.

Disposed within cap member 120 is a sliding member 124 substantially identical to sliding member 48 illustrated in FIGS. 2 through 5. However, sliding member 124 does not have tab projections 72 extending into the plug prong receiving apertures but rather has generally rectangular shaped apertures 126 therein. The elimination of tab portions 72 allows for the use of an unmodified conventional plug in this safety outlet. Sliding member 124 is biased toward the right, as viewed in FIG. 9, by spring 126. Spring 126 will be of a sufficient stiffness to prevent sliding member 124 from being moved to the right by the insertion of an object in a single one of the apertures, but will allow sliding member 124 to move to the left in response to the insertion of the prongs of a plug. This will necessarily increase the effort required to insert a plug but, as the two prongs thereof will both engage the inclined walls 128 of the apertures, it is possible to exert a sufficiently strong force to overcome the spring force without bending or otherwise damaging the plug prongs in the process. As is readily apparent, the sliding member will be caused to move to the left by the prongs of a plug as it is inserted through sliding member 124 thereby exposing apertures 130 in the retainer plate 134 which allow the prongs to engage the electrical contacts therebelow. As the plug is withdrawn, the biasing force exerted by spring 126 will automatically cause sliding member 124 to move toward the right, as viewed in FIG. 9, thus closing off access to the electrical contacts.

Should it be desirable to further insure against actuation of this sliding member by an object inserted in one of the plug prong receiving apertures, such as may occur should a sufficiently stiff object be inserted, a locking means may be easily provided therefor. Such an embodiment of the present invention is illustrated in FIGS. 10 through 14. The embodiment shown in FIGS. 10 and 11 and indicated generally at 132 comprises a cap member 120 which is identical to the cap member of FIG. 9 and thus indicated by the same reference numeral. Cap member 120 is fixedly secured to a retainer plate 134 with a sliding member 136 disposed therein. Sliding member 136 is similar to that shown in FIG. 9 having a pair of spaced apart generally rectangular shaped apertures 138 therein defined by a substantially vertical wall 140 and an opposite inclined wall 142 with a pair of spaced apart parallel walls extending therebetween. Inclined wall 142 has a generally rectangular opening therein leading to an irregular shaped chamber 144 which passes through to the bottom of the sliding member. This opening is adapted to accommodate pivot arm member 146 and a spring 148 for biasing the pivot arm. Pivot arm member has two arms 150 and 152, one of which (150) extends upward and projects through the opening in the inclined wall in such a manner as to extend partially across the opening in the cap member when the sliding member is in the right hand or "safe" position. The second arm 152 of pivot arm member 146 projects downward through the bottom opening of the sliding member and into a recessed portion 154 of the retainer plate 134. Pivot arm member 146 is rotatably secured in chamber 144 by means of a pin 156 about which pivot arm member 146 is adapted to rotate. Spring 148 is mounted on pin 156 and engages arms 150 and 152 so as to bias the pivot arm member into the recessed portion 154 provided in the retainer plate. A second pivot arm, identical to the first, is similarly situated adjacent the second aperture of the sliding member and indicated by identical reference numerals.

Figure 10:
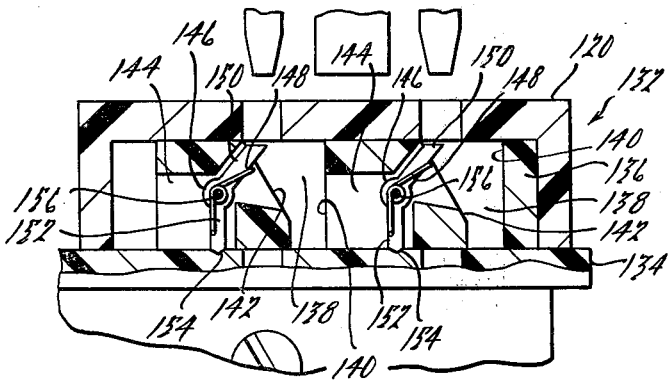
FIG. 10 is a sectionalized view of yet another embodiment of the present invention similar to that of FIG. 2.
Figure 11:
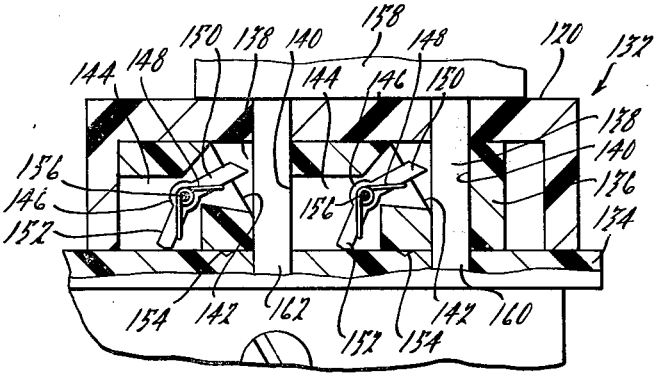
FIG. 11 is a sectionalized view of the embodiment of FIG. 10 having a plug inserted in operable position.

The operation of this device is best seen with reference to FIG. 11, in which there is shown a conventional plug 158 having prongs 160 and 162 fully inserted in operable relationship to the safety outlet of FIG. 10. As is readily apparent from FIGS. 10 and 11, when the outlet is not being used, the sliding member 136 will be positioned to the extreme right within cap 120 and each of the two pivot arm members 146 will engage their respective recesses 154 provided in the retainer plate 134, thus preventing the sliding member from being moved to the left unless they are both first released. When a conventional plug 158 is inserted through the apertures in the cap member, the prongs will engage the upward extending arm 150 of the pivot arm member 146. Each of the prongs thus causes the pivot arm to rotate about the pin 156, thereby moving each of the lower arms 152 out of recesses 154 in the retainer plate which allows sliding member 136 to move laterally to the left. Once the sliding member has moved sufficiently far to the left, the pivot arm members 146 will move out of engagement with the plug prongs 160 and 162 and the spring will cause them to snap upward but, as the sliding member has now been moved to the left, the lower arms will no longer be able to reengage the recesses in the retainer plate. Thus, the plug will be able to cause the sliding member to continue its lateral movement, thereby affording the prongs access to the electrical contacts through apertures provided in the retainer plate 134. When the plug is removed, a spring 164 will move the sliding member laterally to the right and pivot member springs 148 will cause the respective lower arm members 152 of the pivot arms 146 to reengage the recesses 154 provided in the retainer plate. It is readily apparent that since two separate independent pivot locking arms are employed, that one must simultaneously insert objects in both of the prong receiving apertures in order to simultaneously release both locks in order to allow the sliding member to move laterally, thereby affording access to the electrical contacts housed below the retainer plate. The probability that a child will simultaneously insert two objects into each of the prong receiving apertures is extremely remote and considering the manual dexterity required to accomplish this task, it becomes apparent that this embodiment of the present invention offers a substantially shock proof outlet which is extremely simple to use and automatically returns to a safe position when a plug is removed therefrom.

Figure 13:
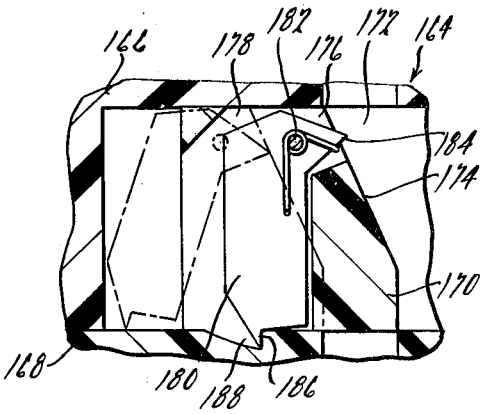
FIG. 13 is a view of a portion of an electrical connector illustrated in section showing yet another embodiment of the present invention.

Referring now to FIG. 13, there is illustrated therein a portion of a safety outlet showing yet another embodiment of the present invention indicated generally at 164. Safety outlet 164 is of a similar construction to safety outlet 132 of FIGS. 10 and 11, having a cap member 166 secured to a retaining plate 168 which is, in turn, secured to a housing in which are disposed conventional electrical contacts. Cap member 166 is substantially identical to cap member 120 of FIGS. 10 and 11 and further description thereof is omitted.

Similarly to that described previously, cap member 166 has movably disposed therein a slidable member 170 having a construction similar to that of slidable member 136, including a pair of generally rectangular apertures 172 extending therethrough, similar to those previously described and partially defined by an inclined wall portion 174. An aperture 176 opens into an irregular shaped chamber 178 in which a pivot member 180 is movably disposed. Pivot member 180 is adapted to rotate about a pin 182 and also has a portion 184 which projects into aperture 172 so as to engage the prong of a plug as it is inserted therein. Pivot member 180 also has a generally tooth-like projection 186 at the lower end thereof which is adapted to cooperate with a recess 188 provided in retainer plate 186 so as to provide a locking means for slidable member 170. A spring (not shown) as previously described, is provided extending between slidable member 170 and cap 166 so as to bias slidable member 170 to the right, as illustrated. The prong of a conventional plug will engage portion 184 as it is inserted which will cause pivot member 180 to rotate clockwise withdrawing projection 186 from recess 188 allowing slidable member 170 to be moved to the left as viewed in FIG. 13, with pivot member then becoming positioned, as illustrated in phantom, and thereby allowing the prongs to pass through to engage the electrical contacts therebelow. Projection 186 will prevent movement of slidable member 170 unless first released, as described. As is readily apparent, slidable member 170 may be provided with either one locking means, as herein described, in which case, the second prong receiving aperture of safety outlet 164 would be of a similar construction as that illustrated in FIG. 9 or each aperture may be provided with identical locking means, as herein described.

Figure 14:
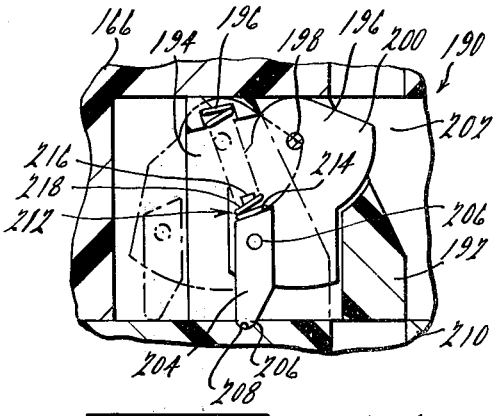
FIG. 14 is a view similar to that of FIG. 13 but illustrating another embodiment of the present invention.
Figure 12:
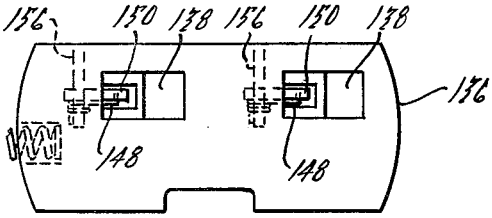
FIg. 12 is a top view of the sliding member of the embodiment illustrated in FIGS. 10 and 11.

FIG. 14 illustrates yet another embodiment of the present invention indicated generally at 190 and having yet another modified locking means. In this case, slidable member 192 has a substantially identical construction to the slidable members previously described with reference to FIGS. 10, 11 and 13 with the exception of a slightly different shaped chamber 194 and a spring retention seat 196 formed within this chamber. Chamber 194 has a first pivot member 196 disposed therein and adapted to rotate about pin 198, which is supported in a slidable member 192. First pivot member 196 has a projection 200 extending into aperture 202 so as to engage the prongs of a plug as it is inserted therein, similar to that previously described above. A second pivot member 204 is movably secured to first pivot member 196 by pin 206 in such a manner as to allow it to rotate with respect to pivot member 196. Pivot member 204 has a lower projection 206 which is adapted to sit in a recess 208 provided in retainer plate 210 when slidable member 192 is in a safe position, thereby locking the slidable member in this safe position. A spring seat 212 is provided at the upper end of pivot member 204 having a shoulder portion 214 and a pin projection 216. A spring 218 is adapted to fit over projection 216 and sit on shoulder portion 214 and extend upward at a slight angle into spring retention seat 196. In this manner, spring 218 will bias pivot member 204 into recess 208, as well as biasing pivot member 196 into a position where projecting 200 will engage the prongs of a plug as it is inserted into the safety outlet. It should be noted that while the embodiment of FIGS. 13 and 14 have been described as having a locking means disposed in only one of the apertures through which a plug prong passes, an identical locking arrangement may be provided in the second aperture in like manner, thereby further increasing the safety factor afforded by the present invention as the release of either latching means alone will not allow the slidable member to be moved.

The locking means of the embodiment shown in FIG. 14 may be easily operated through the insertion of a plug prong which will engage projection 200 causing pivot member to rotate in a clockwise direction about pin 198 lifting lower projection 206 of pivot member 204 out of recess 208, thereby releasing slidable member 192. Slidable member 192 will then be caused to slide to the left, as illustrated therein, which will allow the prongs to pass through to engage the electrical contacts located below retainer plate 210. Upon withdrawal of the plug from the safety outlet, slidable member 192 will be caused to move to the right by a spring biasing means (not shown) extending between slidable member 192 and cap member 166, as previously described. Spring 218 will then cause projection 206 to pivot member 204 to move back into the recess 208 thereby locking slidable member 192 in a safe position.

There is thus disclosed herein a unique safety outlet which provides a convenient easy to use electrical connection which eliminates the potential hazard of electrical shock should a conductive material be inserted therein, either inadvertently or purposefully by children. Further, the present safety outlet prevents an individual from accidently unplugging an appliance or the like from an outlet and inadvertently forgetting to replace a protective device or return the outlet to its protected condition. An additional advantage of the present outlet, particularly when applied to extension cords which are often pulled from one end to reach a particular location, is that the plug retention mechanism will prevent the two portions from becoming separated as a result of the tension forces exerted thereon.

While this safety outlet has been described with particular reference to a conventional duplex outlet and an extension cord connector, it is readily apparent that the features of this device may be easily incorporated into other electrical connectors, such as for single or other multiple oulet configurations. Thus, the preferred embodiments herein described should not be taken as limiting the scope, proper spirit or fair meaning of the appended claims.

I claim:

1. A safety outlet comprising:

a housing having electrical contacts disposed therein adapted to engage the prongs of a plug;

a cover member secured to said housing and having apertures disposed therein adapted to allow said prongs to pass through said cover member to engage said contacts; and a rotatable member movably secured to said cover member, said rotatable member having apertures therein adapted to receive said prongs and further having means provided thereon engaging said cover member to prevent rotation thereof when said rotatable member is in a first predetermined position, said means being adapted to be released in response to the insertion of said prongs in said apertures of said rotatable member, whereby said rotatable member may be rotated from said first predetermined position in which access to said apertures of said cover member is effectively blocked by said rotatable member to a position in which said apertures are aligned, thereby allowing said prongs to pass through said cover member apertures and engage said contacts, said rotatable member further including a slidable member disposed within said rotatable member, said slidable member being adapted to cooperate with said cover member to limit the rotation of said rotatable member.

2. A safety outlet as set forth in claim 1 wherein said slidable member has apertures adapted to allow said prongs to pass through said slidable member, said slidable member being further adapted to prevent the removal of said prongs when said rotatable member is in a position other than said first predetermined position.

3. A safety outlet as set forth in claim 2 wherein said rotatable member is generally cylindrical in shape having a channel extending between opposite sidewall portions thereof, said slidable member being movably disposed in said channel so as to allow said slidable member to move between said sidewall portions and further comprising means biasing said slidable member toward one of said sidewall portions.

4. A safety outlet as set forth in claim 3 wherein said slidable member has a protrusion engaging a groove on said cover member, said protrusion adapted to prevent rotation of said rotatable member when said rotatable member is in said first predetermined position.

5. A safety outlet as set forth in claim 4 wherein said protrusion is caused to move out of engagement with said groove in response to the insertion of said prongs in said apertures of said slidable member.

6. A safety outlet as set forth in claim 5 wherein said slidable member has tab portions protruding into said apertures, said tab portions adapted to engage elongated apertures in said prongs of said plug when said slidable member is moved out of engagement with said groove and thereby prevent removal of said prongs when said rotatable member is in a position other than said first predetermined position.

7. A safety outlet as set forth in claim 1 wherein said cover member has a groove in its surface and said slidable member has a protrusion engaging said groove, said groove and said protrusion cooperating to limit the rotation of said rotatable member.

8. A safety outlet as set forth in claim 7 wherein said groove has an enlarged portion, said protrusion of said slidable member engaging said enlarged portion thereby preventing rotation of said rotatable member when said rotatable member is in said first predetermined position.

9. A safety outlet comprising:

a housing portion having contact means for electrically engaging the prongs of a plug inserted therein;

a cover member secured to said housing and having apertures therein adapted to allow said prongs to pass through said cover member to engage said contact means;

a rotatable member movably secured to said cover member, said rotatable member having apertures therein adapted to allow said prongs to pass through said rotatable member and further having a channel extending between opposite sidewall portions thereof;

a slidable member disposed in said channel, said slidable member having apertures adapted to allow said prongs to pass through said slidable member, and further having a protrusion engaging a grooved portion of said cover member so as to limit the rotation of said rotatable member;

said grooved portion having an enlarged portion adapted to be engaged by said protrusion when said rotatable member is in a first predetermined position so as to prevent rotation of said rotatable member;

means biasing said protrusion of said slidable member into engagement with said enlarged portion, said apertures of said slidable member being adapted to cause said protrusion to move out of engagement with said enlarged portion in response to the insertion of said prongs, thereby allowing rotation of said rotatable member;

said slidable member further having means adapted to engage elongated apertures in said prongs thereby preventing removal of said prongs when said rotatable member is in a position other than said first predetermined position; and said rotatable member and said slidable member effectively prevent access to said apertures in said cover member when said rotatable member is in said first predetermined position.

10. A safety outlet comprising:

a housing having electrical contacts disposed therein adapted to engage the prongs of a plug;

a cover member secured to said housing and having at least a pair of apertures disposed therein adapted to allow said prongs to pass through said cover member to engage said contacts;

a cap member engaging said cover member, said cap member having at least a pair of apertures therein adapted to receive said prongs;

a slidable member disposed within said cap member and having apertures therein adapted to allow said prongs to pass through said slidable member, said slidable member being laterally movable within said cap member from a first position in which said slidable member prevents access to said apertures in said cover member to a second position in which said apertures of said cover member, said cap member and said slidable member are aligned in response to the insertion of said prongs in said apertures; and locking means provided on said slidable member for securing said slidable member in said first position and adapted to be released by the insertion of said prongs into said slidable member apertures said locking means including a pivot member disposed within a chamber formed in said slidable member and adapted to rotate with respect thereto, said pivot member further having a first portion extending into one of said apertures, said portion being adapted to cause said pivot member to rotate upon engagement with one of said prongs, said pivot member further having a second portion adapted to engage a recess formed in said cover member when said slidable member is in said first position.

11. A safety outlet as set forth in claim 10 wherein said pivot member further includes means biasing said second portion into engagement with said cover member.

12. A safety outlet as set forth in claim 11 wherein said second portion is another pivot member rotatably secured to said pivot member.

13. A safety outlet as set forth in claim 10 wherein said cap member is rotatably secured to said cover member and further including means biasing said slidable member toward said first predetermined position, said slidable member having means cooperating with said cover member to prevent rotation of said cap member.

14. A safety outlet comprising:

a housing having electrical contacts disposed therein adapted to engage the prongs of a plug;

a cover member secured to said housing and having at least a pair of apertures disposed therein adapted to allow said prongs to pass through said cover member to engage said contacts;

a cap member secured to said cover member, said cap member having at least a pair of apertures adapted to receive said prongs;

a slidable member disposed within said cap member and having apertures therein adapted to allow said prongs to pass through said slidable member, said slidable member being laterally movable within said cap member from a first position in which said slidable member prevents access to said apertures in said cover member to a second position in which said apertures of said cover member, said cap member and said slidable member are aligned in response to the insertion of said prongs in said apertures;

means urging said slidable member into said first position;

a pair of pivotable members disposed within said slidable member, each of said pivotable members having a portion adapted to engage respective prongs of said plug upon the insertion thereof into respective of said apertures, each of said pivot members being further adapted to engage a recess provided in said cover member when said slidable member is in said first position, and to be moved out of said recess in response to the insertion of said prongs; and means urging said pivot member into engagement with said cover member.

* * * * *